US009108335B2

(12) United States Patent
Beakler et al.

(10) Patent No.: US 9,108,335 B2
(45) Date of Patent: Aug. 18, 2015

(54) MATERIAL SURFACE DISTRESSING BLADE

(75) Inventors: Brian W. Beakler, York, PA (US); Matthew S. Myers, Lititz, PA (US)

(73) Assignee: AWI Licensing Company, Wilmington, DE (US)

( * ) Notice: Subject to any disclaimer, the term of this patent is extended or adjusted under 35 U.S.C. 154(b) by 253 days.

(21) Appl. No.: 13/442,966

(22) Filed: Apr. 10, 2012

(65) Prior Publication Data

US 2013/0263717 A1 Oct. 10, 2013

(51) Int. Cl.

| | |
|---|---|
| ***B27G 17/00*** | (2006.01) |
| ***B27C 1/00*** | (2006.01) |
| ***B27G 17/04*** | (2006.01) |
| ***B27M 1/00*** | (2006.01) |

(52) U.S. Cl.

CPC ..... *B27C 1/002* (2013.01); *B27G 17/04* (2013.01); *B27M 1/003* (2013.01)

(58) Field of Classification Search

USPC ..... 144/154.5, 358, 115, 149; 30/169–172, 30/346.55, 356, 357

See application file for complete search history.

(56) References Cited

U.S. PATENT DOCUMENTS

| | | | | |
|---|---|---|---|---|
| 1,751,034 A | | 3/1930 | Erb | |
| 3,474,706 A | * | 10/1969 | Wheeler | 409/293 |
| 4,627,128 A | * | 12/1986 | Shea | 15/236.07 |
| 4,768,254 A | * | 9/1988 | Bell | 15/236.01 |
| 5,713,232 A | * | 2/1998 | Hodge | 70/456 R |
| 6,732,395 B2 | * | 5/2004 | Gringer | 15/105 |
| 2005/0081391 A1 | * | 4/2005 | Denker | 30/478 |

FOREIGN PATENT DOCUMENTS

| | | |
|---|---|---|
| FR | 459372 A | 11/1913 |
| FR | 1567583 A | 5/1969 |
| GB | 541019 A | 11/1941 |

OTHER PUBLICATIONS

International Search Report for PCT/US13/35942, Filed Apr. 10, 2013. WO.

International Search Report for PCT/US13/36022, Filed Apr. 10, 2013. WO.

* cited by examiner

*Primary Examiner* — Stephen Choi

(74) *Attorney, Agent, or Firm* — Amy M. Fernandez

(57) ABSTRACT

A blade including a body has a front surface and a curved back cutting surface. The front surface has a mount angle relative to a material surface of a material facing the back cutting surface. The back cutting surface has a substrate clearance angle relative to the material surface. In response to at least one of the blade and the material surface being brought into cutting contact and moved relative to each other, a resulting portion of the material surface has a distressed appearance.

21 Claims, 1 Drawing Sheet

MATERIAL SURFACE DISTRESSING BLADE

FIELD OF THE INVENTION

The present invention relates to blades, and more specifically, the present invention relates to blades that are configured to distress a surface of a material.

BACKGROUND OF THE INVENTION

It has become fashionable to subject furniture and other objects/fixtures or surfaces of walls or flooring of a structure, such as a residence to a design style or technique sometimes referred to as distressing or antiquing. These design styles are intended to "age" the surface of the item or object treated to achieve a unique and/or rustic look. In one aspect of this design style, the surface of the item may be subjected to operations such as sanding, denting, and/or scraping. Typically these types of operations would be performed on furniture or other items, including walls or flooring that are composed of a cellulose-containing material, such as wood and composite board to produce a distressed surface.

Aspects of a distressed surface can include random irregularities formed in the surface of a material, such as variations relating to depth, width and length of the formed surface irregularity by a tool brought into contact with the material surface, as well as random locations along the surface of the material being scraped. In addition, imperfections are typically desirable, and can occur in response to variations, especially abrupt changes, in mechanical properties of a material having a surface to be distressed. Such changes or variations in mechanical properties could relate to density or hardness of the material. Examples include knots, burls and changes in grain direction, such as commonly associated with wood. The desirable appearance of a material surface variation such as a burl, for example, would typically exhibit discontinuities, sometimes referred to as "chattering", such as formed by a scraping tool in the material surface both prior to and subsequent to a scraping tool encountering the burl.

Known constructions of apparatus have been devised in an attempt to produce materials having the desired aspects associated with a distressed material surface. Such constructions, have included sanding heads having discontinuities formed therein, molded heads that are placed in a pressurized contact with a material surface, as well as embossing drums or plates. However, all known apparatus have failed to produce the desired features associated with a distressed material surface.

A blade that can produce the desired features associated with a distressed material surface in a material would be desirable in the art.

BRIEF DESCRIPTION OF THE INVENTION

According to an embodiment, a blade includes a body having a front surface and a curved back cutting surface of between about a 12 inch radius and about an 18 inch radius. The front surface has a mount angle of between about 92 degrees and about 98 degrees relative to a material surface of a material facing the back cutting surface. The back cutting surface has a substrate clearance angle of between about 1 and about 3 degrees relative to the material surface. In response to at least one of the blade and the material surface being brought into cutting contact and moved relative to each other, a resulting portion of the material surface is distressed.

According to another embodiment, a blade includes a body having a front surface and a curved back cutting surface of about a 15 inch radius. The front surface has a mount angle of about 96 degrees relative to a material surface of a material facing the back cutting surface. The back cutting surface has a substrate clearance angle of about 2 degrees relative to the material surface. In response to at least one of the blade and the material surface being brought into cutting contact and moved relative to each other, a resulting portion of the material surface is distressed.

According to another embodiment, a method for distressing a surface of a material includes providing a body having a front surface and a curved back cutting surface of between about a 12 inch radius and about an 18 inch radius. The body includes an angle subtended between the front surface and the back cutting surface and being between about 77 degrees and about 85 degrees. The method further includes positioning the front surface between about 92 degrees and about 98 degrees relative to a material surface of a material facing the back cutting surface. The method further includes positioning the back cutting surface between about 1 and about 3 degrees relative to the material surface. The method further includes directing the blade and the material surface into cutting contact, and moving at least one of the blade and the material surface relative to each other.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a blade for distressing a surface of a material such as by cutting, which is intended to include scraping. Embodiments of the present disclosure permit fabrication of materials having distressed surfaces not previously available, providing a substantially equal distribution of forces applied to the material surface by the blade. The blade is configured to have an extended life cycle. The blade is configured to be positioned in a substantially fixed orientation relative to the material surface, resulting in an optimum cutting contact with the material surface. It is intended that the term cutting contact include scraping, i.e., that the blade is removing shavings and/or chips from the material surface.

For purposes of the disclosure, a distressed surface is intended to exhibit a number of characteristics or aspects. For example, a distressed surface or material surface having a distressed appearance or the like is intended to include random irregularities formed in the surface of a material, such as variations relating to depth, width and length of the formed surface irregularity, such as by at least one embodiment of a blade of the present disclosure brought into contact with the material surface, as well as random locations along the surface of the material being distressed. In addition, a distressed surface is intended to include imperfections that may occur in response to variations, especially abrupt changes, in mechanical properties of a material having a surface to be distressed. Such changes or variations in mechanical properties could relate to density or hardness of the material. Examples include knots, burls and changes in grain direction, such as commonly associated with wood. With a distressed surface, the desirable appearance of a material surface variation such as a burl, for example, would typically exhibit discontinuities, sometimes referred to as "chattering", such as formed by an embodiment of a blade of the present disclosure. The discontinuities would be manifested in the material surface at locations both prior to and subsequent to an embodiment of a blade of the present disclosure encountering the burl.

It is to be appreciated that another material may include cellulose-containing materials, such as composite board.

Figure 1:
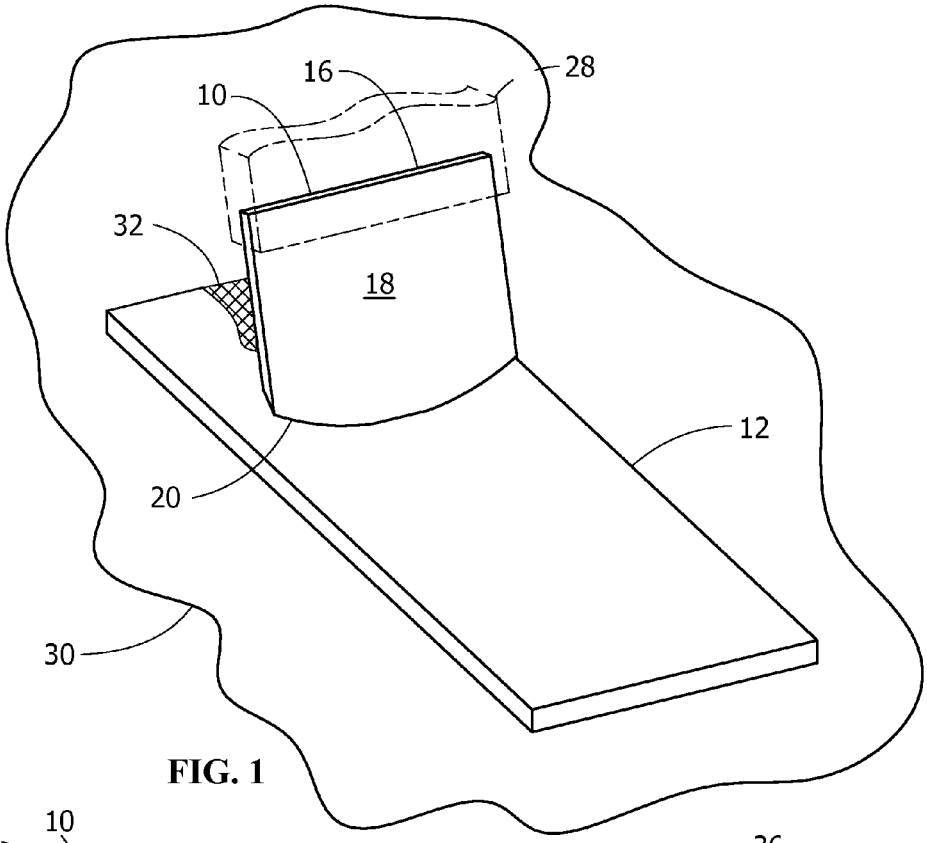
FIG. 1 illustrates a perspective view of an exemplary blade according to an embodiment of the disclosure.

As shown in FIG. 1, a blade 10 of the present disclosure includes a body 16 having a front surface 18 and a back cutting surface 20. Shown opposite back cutting surface 20 is a blade support 28 for blade 10. A material 12, such as a board, includes a surface 14 that is positioned facing back cutting surface 20. As further shown in FIG. 1, material support 30 is provided for supporting material 12. In one embodiment, blade support 28 and material support 30 are interconnected. In use, in response to at least one of blade 10 and material surface 14 being brought into cutting contact and moved relative to each other, a resulting portion of material surface 14 is a distressed surface 32. For purposes of the present disclosure, the terms cutting surface and cutting contact are also intended to include abrading contact, such as scraping surface 14 of material 12.

In one embodiment, blade 10 is constructed of a single, contiguous material, such as a steel, such as M2 tool steel, or other suitable material that maintains an edge, even when subjected to impact, such as between the blade and the material surface. In another embodiment, blade 10 may be formed of several materials joined together, such as by welding, if desired. It is to be understood that the material, as well as the geometry of the blade and the orientation of the blade relative to the surface of a material brought into cutting contact with the blade, contribute to an increase life cycle of the blade of the present disclosure, as compared to other blade constructions.

Figure 2:
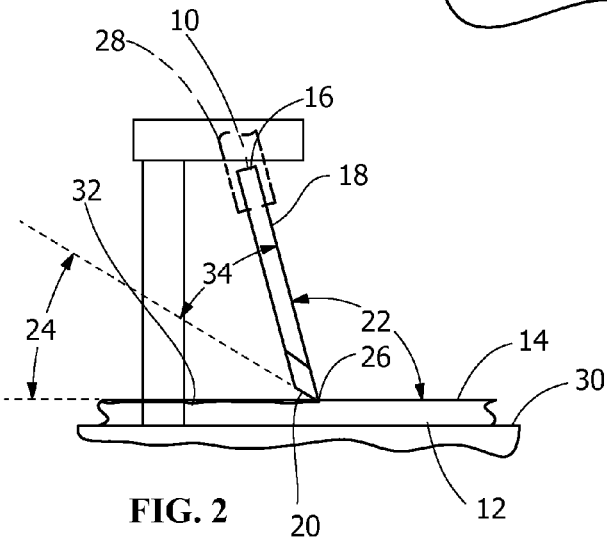
FIG. 2 illustrates a side view of the blade of FIG. 1, according to an embodiment of the disclosure.
Figure 3:
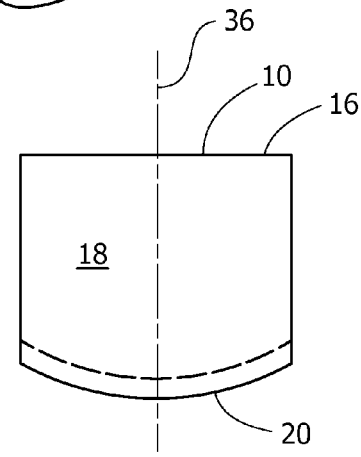
FIG. 3 illustrates a front view of the blade of FIG. 1, according to an embodiment of the disclosure.

As shown in FIGS. 2-3, which are not to scale in order to more clearly show and describe features of the present disclosure, blade 10 includes an acute blade angle 34 subtended between front surface 18 and back cutting surface 20, which surfaces intersect at a point or tip 26. In one embodiment, blade angle 34 is between about 77 degrees and about 85 degrees, between about 78 degrees and about 85 degrees, between about 79 degrees and about 85 degrees, between about 80 degrees and about 85 degrees, between about 81 degrees and about 85 degrees, between about 82 degrees and about 85 degrees, between about 83 degrees and about 85 degrees, between about 84 degrees and about 85 degrees, between about 77 degrees and about 84 degrees, between about 77 degrees and about 83 degrees, between about 77 degrees and about 82 degrees, between about 77 degrees and about 81 degrees, between about 77 degrees and about 80 degrees, between about 77 degrees and about 79 degrees, between about 77 degrees and about 78 degrees, between about 78 degrees and about 84 degrees, between about 79 degrees and about 83 degrees, between about 80 degrees and about 82 degrees, between about 80 degrees and about 81 degrees, or any suitable range or sub-range thereof. In one embodiment blade angle 34 is about 77 degrees, about 78 degrees, about 79 degrees, about 80 degrees, about 81 degrees, about 82 degrees, about 83 degrees, about 84 degrees, about 85 degrees, or any suitable sub-range thereof. In another embodiment, the magnitude of blade angle 34 can vary within the above referenced ranges, as a function of distance from a central axis 36. It can be appreciated by virtue of blade angle 34 approaching 90 degrees, versus having an angle of reduced magnitude, that blade 10 contains more material, and is thus a more robust construction.

As further shown in the figures, in one embodiment, curved back cutting surface 20 defines a profile of between about a 12 inch radius and about an 18 inch radius, between about a 13 inch radius and about an 18 inch radius, between about a 14 inch radius and about an 18 inch radius, between about a 15 inch radius and about an 18 inch radius, between about a 16 inch radius and about an 18 inch radius, between about a 17 inch radius and about an 18 inch radius, between about a 12 inch radius and about a 17 inch radius, between about a 12 inch radius and about a 16 inch radius, between about a 12 inch radius and about a 15 inch radius, between about a 12 inch radius and about a 14 inch radius, between about a 12 inch radius and about a 13 inch radius, between about a 14 inch radius and about a 17 inch radius, between about a 15 inch radius and about a 16 inch radius, or any suitable range or sub-range thereof. In one embodiment curved back cutting surface 20 defines a profile that has about a 12 inch radius, about a 13 inch radius, about a 14 inch radius, about a 15 inch radius, about a 16 inch radius, about a 17 inch radius, about an 18 inch radius, or any suitable sub-range thereof. In other embodiments, curved back cutting surface 20 can define any radius or non-radial (e.g., oval) curve falling within this range. In another embodiment, as shown in FIG. 3, the profile of curved back cutting surface 20 is symmetric about central axis 36, although in another embodiment, curved back cutting surface 20 contains no axis of symmetry. That is, the amount or degree of curvature of curved back cutting surface 20 can vary, if desired. This range of size of curved back cutting surface 20 encompasses different amounts of curved back cutting surface 20, similarly corresponding to an amount of penetration or depth of a surface of distressed material surface 32 (FIG. 2) from a "pristine" surface 14 of material 12 for a predetermined amount of force directed between blade 10 and surface 14 of material 12.

As shown in FIG. 2, blade 10 includes an obtuse mount angle 22 subtended between front surface 18 and surface 14 of material 12 facing back cutting surface 20, which surfaces intersect at point or tip 26. In one embodiment, blade angle 34 is between about 92 degrees and about 98 degrees, between about 93 degrees and about 98 degrees, between about 94 degrees and about 98 degrees, between about 95 degrees and about 98 degrees, between about 96 degrees and about 98 degrees, between about 97 degrees and about 98 degrees, between about 92 degrees and about 97 degrees, between about 92 degrees and about 96 degrees, between about 92 degrees and about 95 degrees, between about 92 degrees and about 94 degrees, between about 92 degrees and about 93 degrees, between about 93 degrees and about 97 degrees, between about 94 degrees and about 96 degrees, between about 95 degrees and about 96 degrees, or any suitable range or sub-range thereof. In another embodiment, mount angle 22 is about 92 degrees, about 93 degrees, about 94 degrees, about 95 degrees, about 96 degrees, about 97 degrees, about 98 degrees, or any suitable sub-range thereof. Mount angle 22 defines an angular position or orientation of the front surface 18 of blade 10 with respect to surface 14.

As shown in FIG. 2, blade 10 includes acute substrate clearance angle 24 subtended between back cutting surface 20 and surface 14 of material 12. In one embodiment, clearance angle 24 is between about 1 degree and about 3 degrees, between about 2 degrees and about 3 degrees, between about 1 degree and about 2 degrees, or any suitable range or sub-range thereof. In another embodiment, substrate clearance angle 24 is about 1 degree, about 2 degrees, about 3 degrees, or any suitable sub-range thereof. Substrate clearance angle 24 encompasses a range of angular separation between back cutting surface 20 and surface 14 of material 12 which has been shown to substantially prevent an accumulation of removed material from surface 14 between surface 14 and back cutting surface 20 sufficient to "clog" the space defining the angular separation.

Mount angle 22, blade angle 34, substrate clearance angle 24 and curved back cutting surface 20 associated with blade 10 and surface 14 of material 12 not only exhibit at least the beneficial results separately, as previously identified, but in combination, also unexpectedly results in optimized operation of the blade during cutting contact between blade 10 and surface 14 of material 12 for forming distressed material surface 32. For example, in response to blade 10 encountering changes in mechanical properties of material 12, such as relating to changes or variations in density or hardness of the material 12, blade 10 exhibits discontinuities, sometimes referred to as "chattering". That is, the discontinuities are manifested in the material surface at locations both prior to and subsequent to blade 10 encountering such discontinuities. As a result, the blade of the present disclosure, when brought into cutting contact and moved relative to a material surface, such as the surface of a cellulose-containing material, unexpectedly includes a resulting portion of the material surface having a distressed appearance. In one embodiment, surface 14 of material 12 is substantially planar. In another embodiment, surface 14 of material 12 is nonplanar. It is to be understood that blade 10 of the present disclosure can be used to distress nonplanar surfaces if the blade angular relationships or parameters previously discussed, such as mount angle 22 and substrate clearance angle 24 can be maintained.

In addition, a distressed surface is intended to include imperfections that may occur in response to variations, especially abrupt changes, in mechanical properties of a material having a surface to be distressed. Such changes or variations in mechanical properties could relate to density or hardness of the material. Examples include knots, burls and changes in grain direction, such as commonly associated with wood. With a distressed surface, the desirable appearance of a material surface variation such as a burl, for example, would typically exhibit discontinuities, sometimes referred to as "chattering", such as formed by an embodiment of a blade of the present disclosure. The discontinuities would be manifested in the material surface at locations both prior to and subsequent to an embodiment of a blade of the present disclosure encountering the burl.

It is to be understood that since the angular orientations of the blade are relative to the material surface, there is no set orientation of the material relative to horizontal or vertical reference positioning. That is, the blade and material may be positioned such that chips and/or shavings fall away from the material, due to gravity. In one embodiment the blade can be configured to include a "chip breaker", if desired, as long as the angular relationships between the blade and the material surface, as previously discussed, are maintained.

It is to be appreciated that the amount of force applied between the blade and the material surface can vary widely, depending upon factors including the density or hardness of the material, the speed of the cutting contact of the blade relative to the speed of the material, as well as other factors.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for distressing a material surface of a material, the apparatus comprising:

a blade support;

a blade supported by the blade support;

a material support defining a material support plane, the material support interconnected with the blade support;

the blade comprising a body having a front planar surface, a rear surface opposite the front planar surface, and a curved back cutting surface of between about a 12 inch radius and about an 18 inch radius, the front planar surface and the curved back cutting surface intersecting at a tip, the rear surface and the curved back cutting surface intersecting at a rear edge, the front planar surface forming an acute blade angle with the curved back cutting surface;

the blade support supporting the blade in an orientation so that an obtuse mount angle is formed between the front planar surface of the blade and the material support plane, and the back cutting surface forming an acute substrate clearance angle with the material support plane, wherein the front planar surface of the blade forms the obtuse mount angle with the material support plane without passing through the blade or the material support plane; and the blade support and the material support configured to create relative movement between the material supported on the material support and the blade such that the blade contacts the material surface of the material and moves along the material surface of the material in a first direction, the front planar surface facing the first direction.

2. The apparatus of claim 1, wherein at least a portion of the back cutting surface defines a non-radial curve.

3. The apparatus of claim 1, wherein the back cutting surface further comprises a non-radial curve that is a portion of an oval.

4. The apparatus of claim 1, wherein the back cutting surface is between about a 14 inch radius and about a 16 inch radius.

5. The apparatus of claim 4, wherein the back cutting surface is about a 15 inch radius.

6. The apparatus of claim 1, wherein the mount angle is between about 93 degrees and about 97 degrees.

7. The apparatus of claim 6, wherein the mount angle is between about 94 degrees and about 96 degrees.

8. The apparatus of claim 1, wherein the substrate clearance angle is between about 1 degree and about 2 degrees.

9. The apparatus of claim 1, wherein the substrate clearance angle is between about 2 degrees and about 3 degrees.

10. The apparatus of claim 9, wherein the substrate clearance angle is about 2 degrees.

11. The apparatus of claim 1, wherein the blade is supported by the blade support in a cantilevered manner; and wherein the blade support is configured to maintain the blade in a substantially fixed orientation during said relative movement.

12. The apparatus of claim 1, wherein the body is composed of steel.

13. The apparatus of claim 12, wherein the body is composed of M2 tool steel.

14. A method of distressing a material, the method comprising:

positioning a material on a material support, the material having a planar material surface;

providing a blade having a body having a front planar surface, a rear surface opposite the front planar surface, and a curved back cutting surface of between about a 12 inch radius and about an 18 inch radius, the front surface and the curved back cutting surface intersecting at a tip, the rear surface and the curved back cutting surface intersecting at a rear edge;

positioning the blade so that an obtuse mount angle is formed between the front planar surface of the blade and the planar material surface, wherein the front planar surface of the blade forms the obtuse mount angle with the planar material surface without passing through the blade or the planar material surface;

directing the blade and the planar material surface into cutting contact; and moving at least one of the blade and the planar material surface relative to each other so that the blade moves along the planar material surface of the material in a first direction and chatters during said movement, the front planar surface facing the first direction.

15. The method of claim 14 wherein the material is a board of cellulose-containing material.

16. The method of claim 14 wherein the rear edge trails the tip during said moving, and wherein the blade is in a fixed orientation during said moving step to maintain the mounting angle during said moving step.

17. The method of claim 14 wherein an angle subtended between the front planar surface and the back cutting surface is between about 77 degrees and about 85 degrees.

18. The method of claim 14 wherein the back cutting surface has a profile that is symmetric about a central axis of the blade.

19. A method of distressing a material, the method comprising:

positioning a material on a material support, the material having a planar material surface that defines an X-Z plane of a Cartesian coordinate system;

providing a blade having a body having a front planar surface, a rear surface opposite the front planar surface, and a curved back cutting surface having a radius, the front surface and the curved back cutting surface intersecting at a tip, the rear surface and the curved back cutting surface intersecting at a rear edge;

orienting the blade so that: (1) a Y-Z plane of the Cartesian coordinate system intersects the tip of the blade; (2) the front planar surface of the blade forms an obtuse mount angle with a portion of the planar material surface lying in a positive X sector of the Cartesian coordinate system; and (3) the front planar surface of the blade forms an acute mount angle with a portion of the planar material surface lying in a negative X sector of the Cartesian coordinate system;

directing the blade and the planar material surface into cutting contact while maintaining the blade in said orientation; and moving at least one of the blade and the planar material surface relative to each other while maintaining the blade in said orientation, wherein during said movement the Y-Z plane of the Cartesian coordinate system remains in intersecting relation with the tip of the blade and the portion of the planar material surface lying in the positive X sector passes through the Y-Z plane into the negative X-sector, thereby becoming distressed by the blade, and the blade chatters during said movement.

20. The method of claim 19 wherein the material is a board of cellulose-containing material.

21. The method of claim 20 wherein the front planar surface forms an acute blade angle with the curved back cutting surface.

* * * * *